United States Patent [19]

Ishii

[11] Patent Number: 4,492,006

[45] Date of Patent: Jan. 8, 1985

[54] THREE-TAPE TYPE ZIPPER

[76] Inventor: Takashi Ishii, 14-1423, Kaminakazato 1028, Isogo-ku, Yokohama, Kanagawa, Japan

[21] Appl. No.: 483,756

[22] Filed: Apr. 11, 1983

[51] Int. Cl.[3] ..... A44B 19/34

[52] U.S. Cl. ..... 24/382; 383/38; 383/103

[58] Field of Search ..... 24/382, 383, 384, 386; 150/42; 2/85, 108, 97, 253

[56] References Cited

U.S. PATENT DOCUMENTS

| | | | |
|---|---|---|---|
| 1,996,626 | 4/1935 | Robinson | 24/382 X |
| 2,483,057 | 9/1949 | Levering | 24/382 |
| 2,533,850 | 12/1950 | Syracuse | 150/42 X |
| 2,971,200 | 2/1961 | Lindsey | 24/382 X |
| 4,112,552 | 9/1978 | Lee | 24/382 |
| 4,112,556 | 9/1978 | Flaum | 24/382 |

FOREIGN PATENT DOCUMENTS

| | | | |
|---|---|---|---|
| 63760 | 2/1939 | Norway | 24/382 |
| 391450 | 4/1933 | United Kingdom | 24/382 |

*Primary Examiner*—William E. Lyddane
*Assistant Examiner*—Peter A. Aschenbrenner
*Attorney, Agent, or Firm*—Cushman, Darby & Cushman

[57] ABSTRACT

A three-tape type zipper is disclosed which comprises first to third tapes, a first slider for fastening the first and second tapes and a second slider for fastening the first and third tapes. One end of the first tape and one end of the second tape are connected to each other and one end of the third tape and the other end of the first tape are connected to each other so that the first tape serves as a common counterpart to the second and third tapes. The other ends of the second and third tapes are kept free. The first and second tapes are fastened together by moving the first slider toward the second slider, whereas the first and third tapes are fastened together by moving the second slider toward the first slider.

A bag-shaped article with the three-tape type zipper secured thereto is also disclosed which comprises a body with an opening formed thereon through which things are inserted. The first tape is attached to one of the hems defining the opening, the second tape is to the other hem and the third tape is to the body at the position located distant from the other hem. The first holding capacity is established by fastening the first and second tapes and the second holding capacity smaller than the former is established by fastening the first and third tapes.

As has been described hitherto, this invention will greatly contribute to compactization, material- and cost-saving of commodities.

3 Claims, 8 Drawing Figures

THREE-TAPE TYPE ZIPPER

BACKGROUND OF THE INVENTION

1. Field of the Invention

The present invention relates to a new and unique three-tape type zipper and more particularly to a zipper including three tapes among which the first tape serves as a common counterpart to the second and third tapes. The present invention relates also to useful bag-shaped articles with the three-tape type zipper secured thereto which can be used to create two different holding capacities by fastening a combination of two of the three tapes together.

2. Description of the Prior Art

Hitherto known bag-shaped articles such as special bags used in washing machines or used for shopping or the like have a fixed holding capacity. When items to be contained therein are small or the number of items is limited, the bag becomes relatively big, making it awkward for the bag user to handle. On the other hand, when the items are too big or the number of items is large, it is difficult or impossible to put them all in the bag. In the latter case another bag having larger dimensions is required. A single bag with a zipper secured thereto which functions as either a bigger bag or a smaller bag has been proposed here in this invention.

SUMMARY OF THE INVENTION

Hence, the present invention is intended to obviate the problems as described above with respect to conventional bags or bag-shaped articles with zippers secured thereto.

It is one object of the present invention to provide a three-tape type zipper which can be used conveniently in bags or bag-shaped articles which require two different holding capacities.

It is another object of the present invention to provide a three-tape type zipper which is simple in design and can be manufactured inexpensively.

It is another object of the present invention to provide a bag-shaped article with the three-tape type zipper secured thereto which can be used to create one of two different holding capacities depending on the size and/or number of items to be contained therein.

It is still another object of the present invention to provide a bag-shaped article with the three-tape type zipper secured thereto which can be easily handled by anyone and is light in weight.

To accomplish these objects there is proposed in accordance with the present invention a three-tape type zipper comprised of a combination of: a first tape with a number of equally spaced elements fixed to one of the edges thereof confronting to the other two tapes, one end part of said first tape being connected to one end part of a second tape and the other end part of the same being connected to one end part of a third tape; a second tape with a number of equally spaced elements fixed to one of the edges thereof at a position located opposite to those on said edge of the first tape so that both tapes may be fastened, one end part of said second tape being connected to said one end part of the first tape and the other end part of the same being left free; a third tape with a number of equally spaced elements fixed to one of the edges thereof at a position located opposite to those on said one edge of the first tape so that both tapes may be fastened, one end part of said third tape being connected to said other end part of the first tape and the other end part of the same being left free; a first slider serving to fasten the first and second tapes together by moving the slider with a tab attached thereon from the first end portion where one end part of the first tape is connected to one end part of the second tape to the second end portion where the other end part of the first tape and the one end part of the third tape are connected to each other, said moving the first slider being performed by pulling a tab attached thereon until the first slider comes close to the stopper connecting one end of the third tape and the other end of the first tape; and a second slider serving to fasten the first and third tapes together by moving the slider from the aforesaid second end portion to the aforesaid first end portion with a tab attached thereon until the second slider comes close to the stopper connecting one end parts of the first and second tapes.

The fastening operation is carried out by employing one of two sliders while the unemployed one is kept suspended. After completion of the fastening operation the employed slider should be preferably locked in the conventional manner.

The elements on the first to third tapes are made of synthetic resin such as nylon, polyester, polyacetal or the like material.

Further, according to another aspect of the present invention there is proposed a bag-shaped article with the three-tape type zipper secured thereto to create two different holding capacities comprised of a body having an ellipsoidal cubic configuration, a longitudinal opening formed on said body through which items are inserted and the aforesaid three-tape type zipper including the first to third tapes secured to said body in such a manner that the first tape is attached to one of the hems defining said opening, the second tape is attached to the other hem located opposite to said one hem and the third tape is attached to the body at a position located distant from said other hem whereby the first holding capacity is established by fastening the first and second tapes and the second holding capacity smaller than said first one is established by fastening the first and third tapes.

The bag-shaped article is preferably constructed in the form of a special washing bag to be immersed in a washing tub of a laundry machine.

Usually, the washing bag is constructed of a netlike material.

Other objects, features and advantages of the invention will become apparent from reading the following description made in conjunction with the accompanying drawings.

BRIEF DESCRIPTION OF THE DRAWINGS

The accompanying drawings will be briefly described below.

DETAILED DESCRIPTION OF THE PREFERRED EMBODIMENT

Now, the present invention will be described in further detail hereunder with reference to the accompanying drawings.

Figure 1:
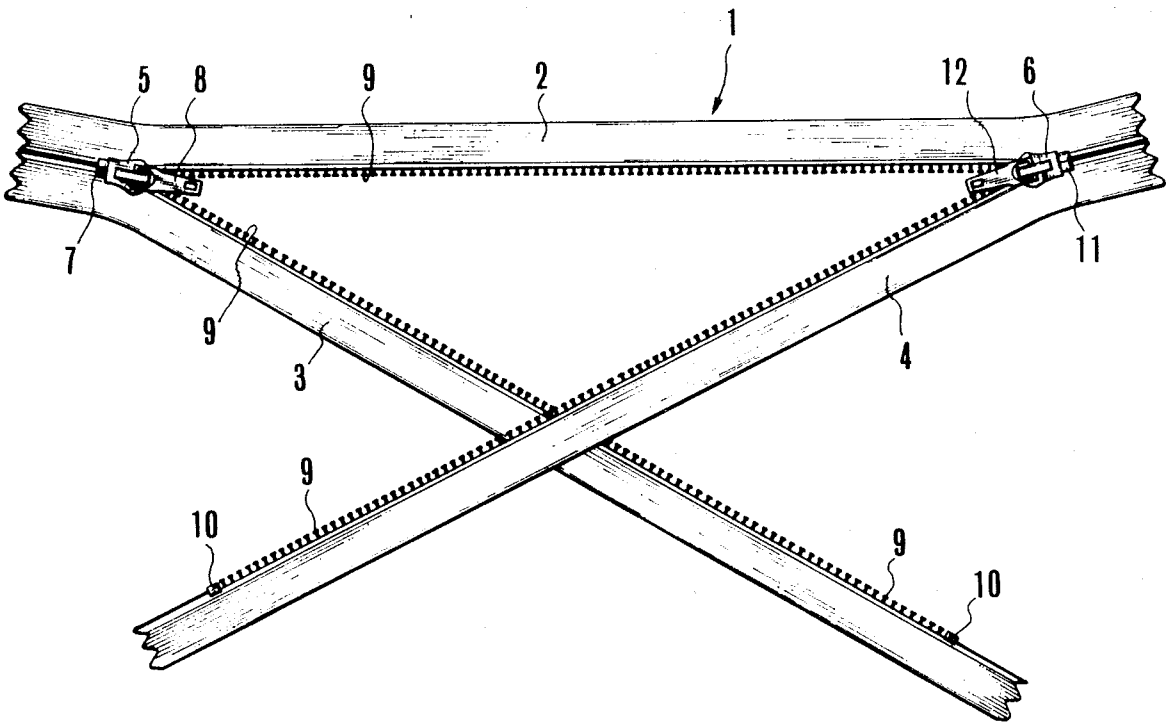
FIG. 1 is a plan view of a three-tape type zipper in accordance with the present invention.
Figure 2:
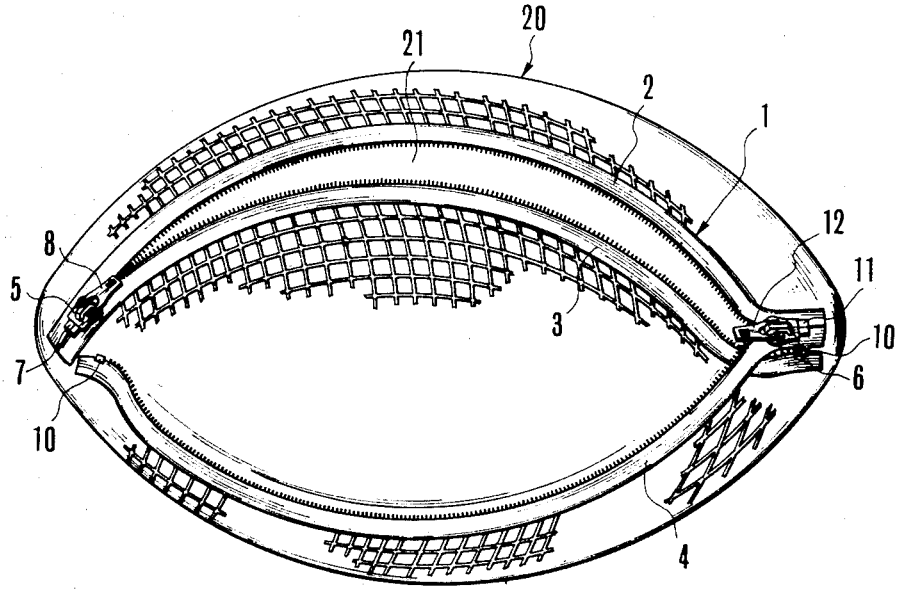
FIG. 2 is a perspective view of an ellipsoidal washing bag with the zipper in FIG. 1 secured thereto, wherein all of three tapes are kept unfastened.
Figure 6:
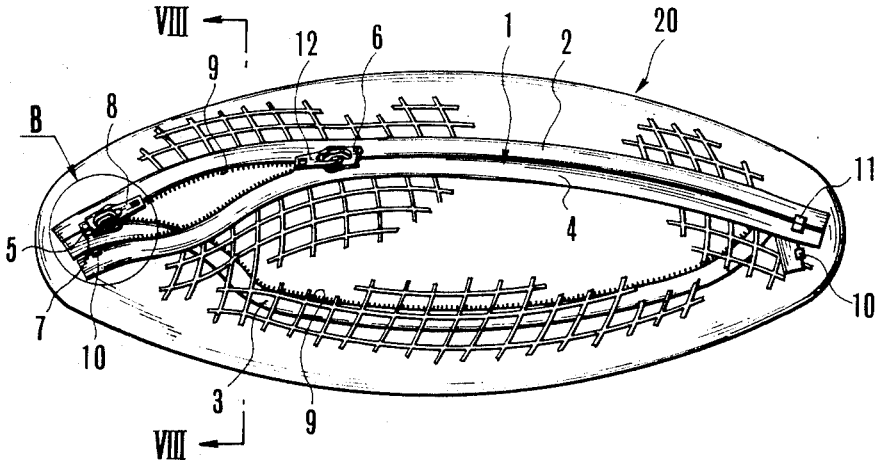
FIG. 6 is a perspective view of the washing bag in FIG. 2, wherein the first and third tapes are being fastened together with the unfastened second tape involved inside the washing bag.

Referring first to FIG. 1, a three-tape type zipper of the invention as generally represented by reference numeral 1 comprises the first tape 2, the second tape 3, the third tape 4, the first slider 5 and the second slider 6. The left end parts of both the first and second tapes 2 and 3 are fixedly connected by means of a stopper 7 and the first slider 5 serves only for fastening the first and second tapes 2 and 3 together with the aid of a tab 8 loosely attached thereon. While the first and second tapes 2 and 3 are kept unfastened as illustrated in FIGS. 1, 2 or 6, the first slider 5 is kept immobile at the left end part of the zipper in the proximity of the stopper 7. As will be readily apparent, the first and second tapes 2 and 3 are fastened to each other by moving the first slider 5 in the rightward direction and on completion of fastening operation the first slider 5 comes close to the stopper 11 which fixedly connects one end of the third tape and the other end of the first one, although the second slider 6 lies between the first slider 5 and said stopper 11. At this moment the first slider 5 is preferably locked by means of one of the conventional built-in locking mechanisms incorporated therein or a lock linked therewith. Reference numeral 9 designates a number of equally spaced elements fixedly disposed along the inside edge of the first to third tapes and reference numeral 10 does a stopper at the free end of either the second tape 3 or the third tape 4. It should be noted that the aforesaid locking mechanism or the aforesaid lock for the first slider 5 is not shown in the drawing but any suitable one may be employed and therefore its detailed description will not be required.

Figure 3:
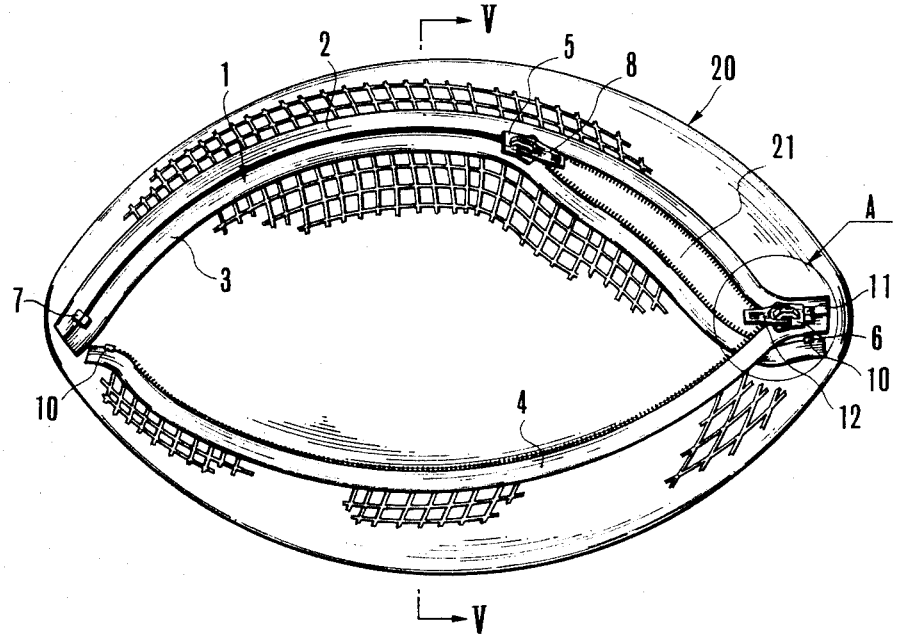
FIG. 3 is a perspective view of the washing bag in FIG. 2, wherein the first and second tapes are being fastened together with the third tape kept unused.

On the other hand, the right end parts of both the first and third tapes 2 and 4 are fixedly connected to each other by means of a stopper 11 quite in the same manner as in the foregoing and the second slider 6 serves only for fastening the first and third tapes 2 and 4 together with the aid of a tab 12 loosely attached thereon. While the first and third tapes 2 and 4 are kept unfastened as illustrated in FIGS. 1 to 3, the second slider 6 is kept immobile at the right end part of the zipper in the proximity of the stopper 11. Specifically, the first and third tapes 2 and 4 are fastened together by moving the second slider 6 in the opposite direction to the first slider 5's fastening direction. On completion of fastening operation the second slider 6 comes close to the stopper 7 which fixedly connects one ends of the first and second tapes 2 and 3, although the first slider 5 rests between the second slider 6 and said stopper 7. At this moment the second slider 6 is favorably locked by means of the same kind of conventional built-in locking mechanism or a lock linked therewith as in the foregoing.

As will be apparent from the above description, a characteristic feature of the zipper consists in that the first tape 2 is a common counterpart to the second and third tapes 3 and 4 and the first and second sliders 5 and 6 are separately operated, that is, when the first slider 5 is operated, the second slider 6 is kept suspended, whereas when the second slider 6 is operated, the first slider 5 is kept suspended.

Next, description will be made as to how the zipper of the invention is practically applied to an ellipsoidal bag-shaped article constituting another part of the invention with reference to FIGS. 2 to 8.

Specifically, the drawings illustrate a so-called washing bag having an ellipsoidal cubic configuration which is usually used by immersing it in a washing tub of a laundry machine for the purpose of preventing clothes in the washing tub from being entangled with each other during washing operation. The washing bag generally represented by reference numeral 20 is made of a net material and equipped with the zipper 1 secured thereto in such a manner that the first tape 2 is attached to one of hems defining an opening 21 through which clothes to be washed are inserted into the washing bag 20, the second tape 3 is attached to the other hem and the third tape 4 is attached to the intermediate part on the ellipsoidal body of the washing bag located distant from the aforesaid hem of the opening 21.

As illustrated in FIG. 2, the stopper 7 as the starting point of the first slider 5 is positioned in the vicinity of the left pole of the ellipsoid and the stopper 11 as the starting point of the second slider 6 is positioned in the vicinity of the right pole of the same so that the opening 21 extends between both the stoppers 7 and 11. All of the first to third tapes 2 to 4 are kept unfastened. It should be noted that the second and third tapes 3 and 4 are dimensioned to have the same length.

FIG. 3 illustrates that the first and second tapes 2 and 3 are being fastened together while the third tape 4 is not in use. In the illustrated state the washing bag has a larger capacity to hold a large volume of clothes in the interior thereof. The first slider 5 is approaching toward the second slider 6 to close the opening 21. After completion of closing operation the washing bag 20 with clothes to be washed contained therein is put into the washing tub (not shown).

Figure 4:
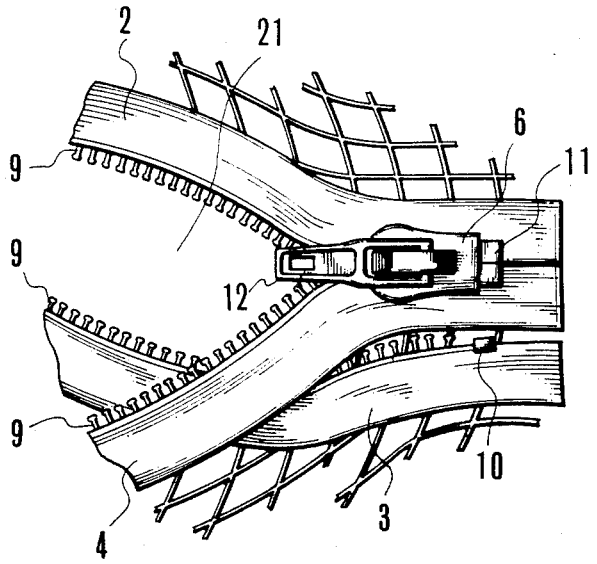
FIG. 4 is a fragmental plan view of a portion A in FIG. 3 located at the righthand end part of the zipper, shown in an enlarged scale.

FIG. 4 illustrates how the second slider 6 and the stopper 10 of the second tape 3 are arranged at the right end part of the zipper shown within the circle A of FIG. 3. On completion of fastening operation for the first and second tapes 2 and 3 the first slider 5 comes in contact with the second slider 6 beyond which the stopper 11 connecting the first and the third tapes 2 and 4 works as a stopper. At this moment the first slider 5 should be preferably locked for inhibiting the washing bag from being opened during washing operation.

Figure 5:
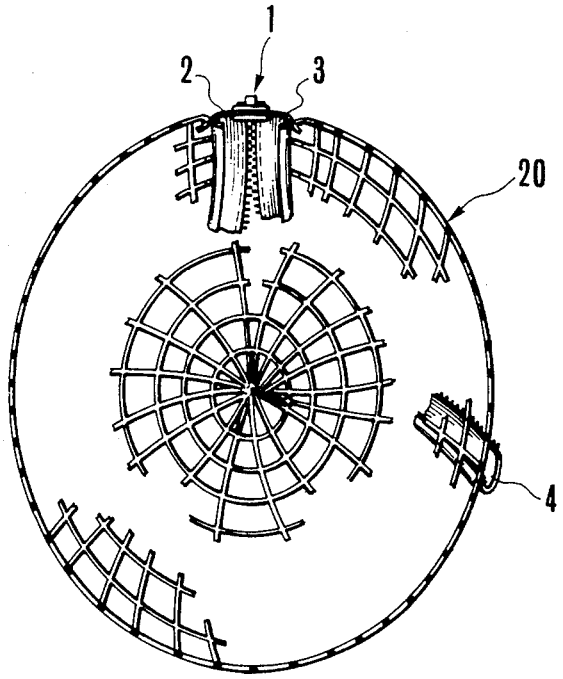
FIG. 5 is a cross-sectional view of the washing bag taken in line V—V in FIG. 3.

FIG. 5 is a cross-sectional view of the washing bag in the condition of FIG. 3. It will be readily understood that the third tape 4 is secured to the body of the washing bag 20 at the position located distant from the hem of the opening 21.

Figure 8:
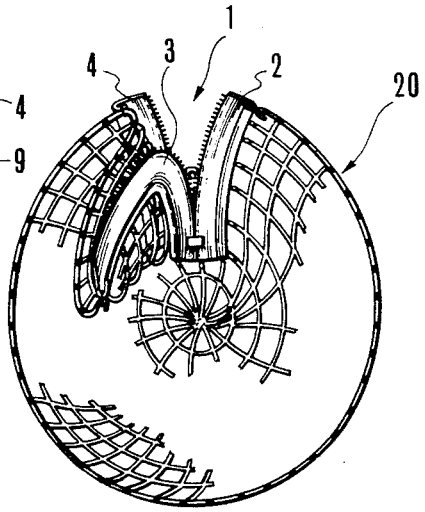
FIG. 8 is a cross-sectional view of the washing bag taken in line VIII—VIII in FIG. 6.

Next, FIG. 6 illustrates that the first and third tapes 2 and 4 are being fastened together by moving the second slider 6 in the leftward direction. In this case the second tape 3 is not in use by inserting an area part of the body of the washing bag extending between the second and third tapes 3 and 4 into the interior of the bag in such a manner as illustrated in FIG. 8. When the first and third tapes 2 and 4 are fastened together, the washing bag has a smaller holding capacity. Thus, when smaller volume of clothes are to be washed, it is convenient that the first and third tapes are fastened together with the clothes put in the washing bag.

Figure 7:
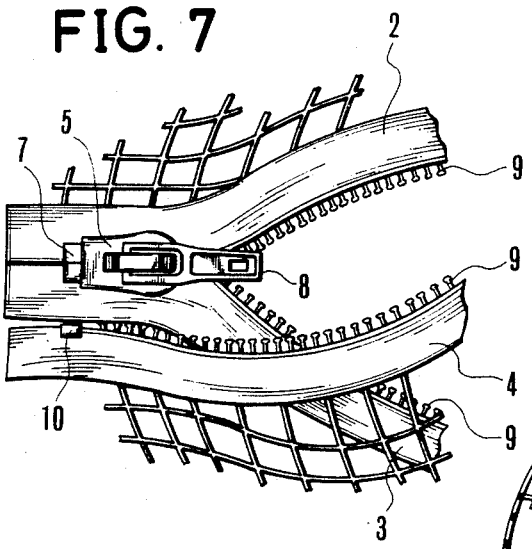
FIG. 7 is a fragmental plan view of a portion B in FIG. 6 located at the lefthand end part of the zipper, shown in an enlarged scale.

Finally, FIG. 7 illustrates how the first slider 5 and the stopper 10 of the third tape 4 are arranged at the left end part of the zipper shown within the circle B of FIG. 6. As is apparent from the drawing, fastening operation is completed for the first and third tapes 2 and 4 with the second slider 6 located in contact with the first slider 5, when two sliders 5 and 6 are kept stopped by the work of stopper 7 connecting the first and second tapes 2 and 3.

The bag-shaped article of the invention has been described above with respect to a washing bag for a laundry machine but the present invention should not be limited only to the above example and it may be applied to other kinds of articles such as keyholder-coin purses, soft type pencil-cases, cosmetic cases, bags for toilet articles, special shopping bags, handbags, sports bags, travel bags or the like.

It should be of course understood that many changes or modifications may be made in any suitable manner without departure from the spirit and scope of the invention.

What is claimed is:

1. A three-tape type zipper essentially comprising in combination;

the first tape with a number of equally spaced elements fixed to one of the edges thereof, one end part of said first tape being connected to one end part of the second tape and the other end part of the same being connected to one end part of the third tape, the second tape with a number of equally spaced elements fixed to one of the edges thereof at the position confronting to those on said edge of the first tape, both tapes being able to be fastened, one end part of said second tape being connected to said one end part of the first tape and the other end part of the same being kept free, the third tape with a number of equally spaced elements fixed to one of the edges thereof at the position confronting to those on said edge of the first tape, both tapes being able to be fastened, one end part of said third tape being connected to said other end part of the first tape and the other end part of the same being kept free, the first slider serving to fasten the first and second tapes together by moving said slider from the first end portion where the one end parts of the first and second tapes are connected to each other to the second end portion where the other end part of the first tape and the one end part of the third tape are connected to each other, said moving of said first slider being performed by means of a tab attached thereon until the first slider is to be stopped by the second slider in contact with the stopper which connects the first and third tapes, and the second slider serving to fasten the first and third tapes together by moving said slider from the aforesaid second end portion to the aforesaid first end portion, said moving of said second slider being performed by means of a tab attached thereon until the second slider is to be stopped by the first slider in contact with the stopper which connects the first and second tapes.

2. A three-tape type zipper as defined in claim 1, wherein the first and/or second sliders have one of built-in locking mechanisms or are linked with a lock to be locked after completion of their fastening operation.

3. A three-tape type zipper as defined in claim 1, wherein the elements on the first to third tapes are made of synthetic resin such as nylon, polyester, polyacetal or like materials.

* * * * *